US006086816A

United States Patent [19]

Lee et al.

[11] Patent Number: 6,086,816

[45] Date of Patent: Jul. 11, 2000

[54] TAP HOLE DRILLING MACHINE FOR BLAST FURNACE, DRILL BIT FOR USE IN TAP HOLE DRILLING MACHINE, AND TAP HOLE DRILLING METHOD

[75] Inventors: Joung Yul Lee; Gap Yeol Kim; Dong Seog Pae, all of Kwangyang, Rep. of Korea

[73] Assignee: Pohang Iron & Steel Co., Ltd., Rep. of Korea

[21] Appl. No.: 09/214,589

[22] PCT Filed: May 8, 1997

[86] PCT No.: PCT/KR97/00080

§ 371 Date: Jan. 7, 1999

§ 102(e) Date: Jan. 7, 1999

[87] PCT Pub. No.: WO98/50590

PCT Pub. Date: Nov. 12, 1998

[51] Int. Cl.[7] ..... C21B 7/12; C21B 7/10

[52] U.S. Cl. ..... 266/45; 266/46; 266/271

[58] Field of Search ..... 266/271, 45, 46

[56] References Cited

U.S. PATENT DOCUMENTS 4,456,083 6/1984 Gozeling et al. ..... 175/415

4,895,349 1/1990 Broom ..... 266/45

FOREIGN PATENT DOCUMENTS 70.21176 1/1972 France ..... 266/271

OTHER PUBLICATIONS

Japanese Patent Abstract No. JP358224104A Dec. 1983.

Japanese Patent Abstract No. JP362107008A May 1987.

*Primary Examiner*—Scott Kastler

*Attorney, Agent, or Firm*—Webb Ziesenheim Logsdon Orkin & Hanson, P.C.

[57] ABSTRACT

A tap hole drilling machine, a drill bit for use in it, and a drilling method are disclosed. A nitrogen gas supply line for pressurised nitrogen as a carrier gas and a cooling water supply line are provided to form water mist for cooling the drill bit, the drill rod, the main body of the drilling machine and the tap hole. Thus the drilling time period is markedly shortened, the molten iron discharge time period is significantly increased, and the net consumption rate of the refractory material is considerably decreased. Therefore, by properly adjusting the amount of the molten iron existing within the lower portion of the blast furnace, the condition of the blast furnace can be stabilized, and the productivity can be improved. Advantageous conditions can be provided for the operation even under a high pressure and a high temperature environment.

4 Claims, 11 Drawing Sheets

TAP HOLE DRILLING MACHINE FOR BLAST FURNACE, DRILL BIT FOR USE IN TAP HOLE DRILLING MACHINE, AND TAP HOLE DRILLING METHOD

BACKGROUND OF THE INVENTION

1. Field of the Invention

The present invention relates to a tap hole drilling machine for producing a molten iron in a blast furnace molten iron making process. The present invention further relates to a drill bit for use in the tap hole drilling machine, and a tap hole drilling method. Particularly, the present invention relates to a tap hole drilling machine, a drill bit for use in it, and a tap hole drilling method, in which a high pressure nitrogen gas is used as a carrying gas for the tap hole drilling, and water mist mixed with cold water is spouted to cool the drill bit, so that the refractory material of the tap hole can be speedily drilled, thereby efficiently carrying out the tap hole drilling operation.

2. Description of the Prior Art

Generally in the blast furnace operation, as shown in FIG. 1, a plurality of tap holes 104 which are formed on the bottom of a blast furnace 100 are either periodically drilled by using a tap hole drilling machine 110, or the tap holes are drilled by using a round bar and by hitting by means of a hammer (not shown in the drawings). Then a slag 101 and a molten iron 120 are tapped through the tap hole 104.

The tap holes 104 are variously different depending on the blast furnace 100, but generally the depth from the blast furnace shell 100*a* to the inner region of the blast furnace is about 3 m.

Generally in a blast furnace 100 having an interior capacity of 3000 $m^3$ or more, there are 3–4 tap holes 104 in a blast furnace 100. Among them, one is periodically repaired, while 2–3 of them are used in turns. Generally, the molten iron tapping time is 120–150 minutes.

Now the operation of the blast furnace will be described in detail. That is, the molten iron 120 and the slag 101 are tapped through the tap hole 104 which is formed in a tap hole wall 105 of FIG. 1. Upon completion of the tapping of the molten iron 120 and the slag 101, the tap hole 104 is closed by means of a refractory material 103. Under this condition, the refractory material 103 is calcined by the high pressure and the high temperature of the internal region of the blast furnace 100, and therefore, the strength of the refractory material is increased. When an operation through one tap hole 104 is completed, another tap hole is used, and in this manner, all the tap holes 104 are ultimately used.

Thus, upon completion of the operation through one tap hole 104, the relevant tap hole 104 is closed. As the time elapses, the refractory material 103 which has been closing the tap hole 104 is more calcined. Therefore, when the tap hole 104 is drilled for reuse, the drilling becomes very difficult.

Meanwhile in the conventional drilling operation, the tap hole 104 of the wall 105 is drilled by using a drill rod 106 and drill bit 107 which is fitted to a main body 118 of the tap hole drilling machine. Or the tap hole 104 is drilled by hammering and by using a round bar.

Under this condition, the refractory material 103 has been calcined and hardened within the blast furnace 100, and therefore, due to impacts of the drilling and the hammering, cracks are easily formed. Consequently, the refractory material 103 is detached in the blast furnace 100, and a gap is formed. Therefore the melt is leaked through the gap, and this leakage molten iron forms a solidified iron (to be called "inside crack") P, with the result that the drilling is rendered significantly more difficult. Accordingly, in the region of the solidified iron P, the drilling efficiency is significantly lowered.

Therefore, in the case where the drilling or hammering becomes difficult, a last means is applied in such a manner that oxygen is injected through a pipe (not shown in the drawings), and that the solidified iron P is dissolved, thereby opening the tap hole 104.

However, in the case where oxygen is injected, the flame of oxygen expands the tap hole 104 or damages the tap hole 104. Further, the opening time for the tan hole 104 is extended, and therefore, the molten iron tapping time is shortened, with the result that the production amount per day is decreased.

This oxygen opening operation usually consumes 20 minutes or more, and therefore, the production of the molten iron is delayed. Meanwhile to the workers, an unexpected tapping of the molten iron 120 and the slag 101 may cause an accident. Further, the management of the amount of the molten iron within the blast furnace 100 and the control of the blast furnace conditions become more difficult. Further, in order to control the blast furnace condition, a continuous molten iron tapping has to be carried out, and thus, the environment for the operation of the blast furnace becomes disadvantageous.

In this conventional tap hole drilling method, the drill rod 106 and the drill bit 107 are threadably fastened together, and this assembly is installed on the tap hole drilling machine 110. Further, in order to discharge the opening debris such as refractory material chips from the tap hole 104 during the tap hole drilling operation, a compressed air of 6 $Kg/cm^2$ is injected from the main body 118 of the tap hole drilling machine 110 toward a flow path 106*a* of the drill rod 106. Thus the compressed air is spouted through a small blowing hole 124 of the drill bit 107 into the tap hole 104.

Further, the drill bit which is used in the conventional opening operation is provided with 4 blowing holes 124 which pass through a drill body 107*a*. The compressed air is injected from an air supply line 119 through the flow path 106*a* of the drill rod 106 and the main body 118 into the tap hole 104. The blowing holes 124 consist of one straight hole and three inclined holes having an angle of 30°. A spouting mouth 71 is formed at the terminus of the straight blowing hole 124 in FIG. 1.

However, in the drill bit 107 which is used in the conventional tap hole opening method, there is almost no inclination (tapering) on the outer circumference of the drill body 107*a*. Further, grooves 107*c* which are formed between bit blades 107*b* on the drill body 107*a* are narrow. Therefore, the opening debris such as the refractory material chins cannot be efficiently discharged. Further the compressed air for cooling by passing through the small blowing holes 124 shows a lowered spouting pressure due to the pressure loss. Further, due to the use of the compressed air for cooling, the drill bit 107 is easily deteriorated in the environment of a high temperature of 1300° C., thereby aggravating the drilling performance.

Further, the spouting pressure of the compressed air is lowered during the drilling operation, and the flow path for the compressed air is clogged by the opening debris, with the result that the drill bit 107 is distorted within the tap hole 104. When the distortion occurs, the discharge of the opening debris is further made difficult. Then the drill bit 107 is more heated within the tap hole 104, and therefore, the drill bit 107 is further deteriorated. This vicious cycle is repeated.

Further, the drill bit 107 is threadably and detachably coupled to the drill rod 106, and the drill rod 106 has to withstand against impacts and the revolution load during the drilling. Further, the drill rod 106 is made of an expensive high strength steel, and therefore, it has to be used with an utmost care, this being a troublesome task.

FIG. 2 illustrates the process steps for opening the tap hole 104 by using the conventional tap hole drilling machine and the conventional drill bit 107.

In this conventional process of FIG. 2, first a step 152 is carried out in which the molten iron 120 and the slag 101 are tapped from the blast furnace 100, then the tap hole is closed by using a refractory material 103, and then, the refractory material 103 is drilled by about 2 m by using the drill bit 107 before the refractory material undergoes a complete calcination.

Then a step 154 is carried out in which the drill rod 106 and the drill bit 107 are removed from the tap hole drilling machine 110.

Then a step 156 is carried out in which a round bar 122 is installed on the tap hole drilling machine to pierce the remaining portion of the refractory material 103.

Then a step 158 is carried out in which, if the piercing by means of the round bar 122 has failed at the step 156, a repiercing is carried out by injecting oxygen.

Then a step 160 is carried out in which it waits until the next molten iron tapping, in a state with the tap hole 104 pierced by the round-bar 122.

Then a step 162 is carried out in which if the molten iron tapping is to be started, the round bar 122 is withdrawn out of the tap hole 104 by using the tap hole drilling machine 110.

Then a step 164 is carried out in which a molten iron tapping operation is carried out through the open tap hole 104.

In this conventional tap hole drilling method, the drill bit and the drill rod have to be replaced with a round bar, and it has to wait in a state with the round bar inserted into the tap hole. Therefore, the tap hole drilling operation is complicated, and much time is consumed, with the result that an efficient tap hole drilling becomes impossible.

SUMMARY OF THE INVENTION

The present invention is intended to overcome the above described disadvantages of the conventional technique.

Therefore it is an object of the present invention to provide a tap hole drilling machine for drilling a tap hole in a blast furnace, in which the refractory material closing the tap hole is speedily pierced, thereby making it possible to carry out an efficient tap hole drilling operation.

It is another object of the present invention to provide a drill bit for drilling a tap hole in a blast furnace, in which even under a hot environment within the tap hole, the tap hole drilling capability is improved so as to achieve a speedy drilling operation, the durability is significantly improved, and the cooling capability is reinforced.

It is still another object of the present invention to provide a tap hole drilling method for drilling a tap hole in a blast furnace, in which during the tap hole drilling operation, the work process is improved so as to pierce the refractory material, and so as carry out an efficient molten iron tapping operation.

In achieving the above objects, the tap hole drilling machine for drilling a tap hole in a blast furnace according to the present invention includes: a frame; a drill bit fitted to a lower portion of the frame; a drill rod with its leading end connected to a rear end of the drill bit; a main body of the tap hole drilling machine with a rear end of the drill rod detachably attached to it, for the purpose of being movable back and forth along the frame, and for rotating the drill bit through the drill rod; and a cooling fluid supply means for supplying a cooling fluid through a central flow path of the drill rod and the main body of the tap hole drilling machine, and for spouting the cooling fluid from a leading end of the drill bit, being characterized in that the cooling fluid supply means is connected to a nitrogen supply line and a cooling water supply line; and a water mist consisting of a cooling water and nitrogen gas for cooling the drill bit is supplied to the main body of the tap hole drilling machine, to the drill rod and to the drill bit, so as to cool the drill bit during the tap hole opening operation.

In another aspect of the present invention, in a drill bit for use in the tap hole drilling machine including: a frame a main body of the tap hole drilling machine for being movable back and forth along the frame, and for rotating the drill bit through the drill rod; and a cooling fluid supply means for supplying a cooling fluid through a central flow path of the drill rod and the main body of the tap hole drilling machine, and for spouting the cooling fluid from a leading end of the drill bit, thereby spouting the cooling fluid into the tap hole of a blast furnace during a tap hole opening operation, the drill bit includes: a drill body with its rear end connected to a leading end of the drill rod; a plurality of bit blades attached to its leading end; triangular recesses formed between the bit blades; a tapered portion with diameters of the drill body decreased from the leading end to its rear end; and a cooling fluid flow path consisting of a straight passage formed through a center line of the drill body, and three inclined passages with a certain angle relative to an axis of the straight passage.

In still another aspect of the present invention, the method for drilling a tap hole while spouting a cooling fluid into the tap hole of a blast furnace according to the present invention includes the steps of:

- installing a drill bit and a drill rod to a main body of a tap hole drilling machine;
- making the main body of the tap hole drilling machine advanced to make the drill bit admitted into the tap hole;
- activating the main body of the tap hole drilling machine to rotate the drill rod and the drill bit so as to drill the tap hole with the drill bit;
- making the drill rod fixedly oriented in a lengthwise direction within the tap hole after some drilling, and supplying nitrogen gas through the main body of the tap hole drilling machine, through the drill rod and through the drill bit into the tap hole;
- supplying a cooling water to be mixed with the nitrogen gas so as to form a water mist, with the drill bit lying within the tap hole, and proceeding with the drilling operation while supplying the water mist;
- stopping the supply of the cooling water but continuously supplying the nitrogen gas after confirming a piercing of the tap hole; and
- injecting the nitrogen gas continuously until the drill bit is completely withdrawn out of the tap hole.

BRIEF DESCRIPTION OF THE DRAWINGS

The above object and other advantages of the present invention will become more apparent by describing in detail the preferred embodiment of the present invention with reference to the attached drawings in which:

FIG. 7 illustrates the operation steps for the tap hole drilling machine according to the present invention, in which:

DETAILED DESCRIPTION OF THE INVENTION

Figure 1:
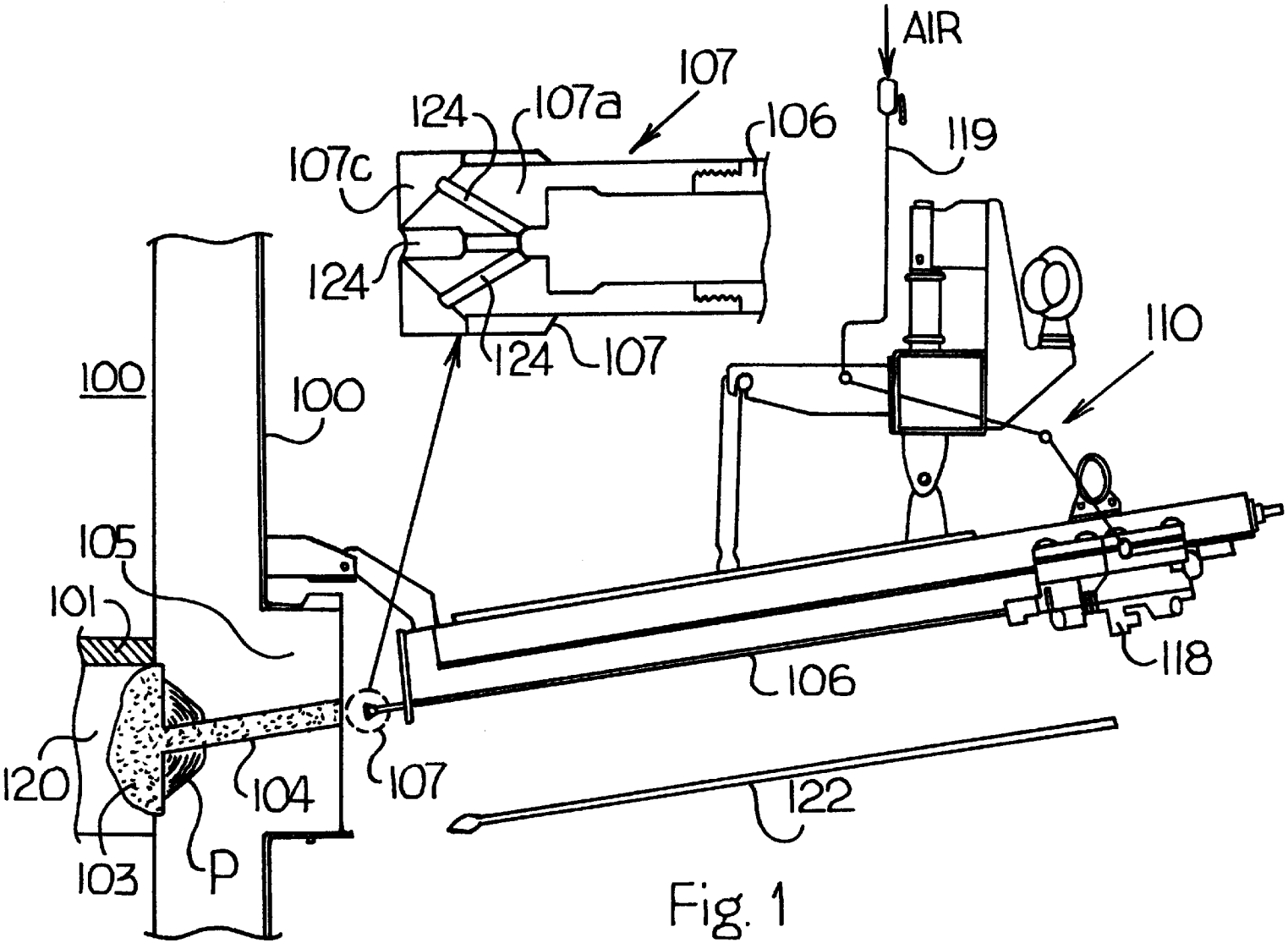
FIG. 1 illustrates the constitution of the conventional tap hole drilling machine for drilling tap holes in a blast furnace.
Figure 2:
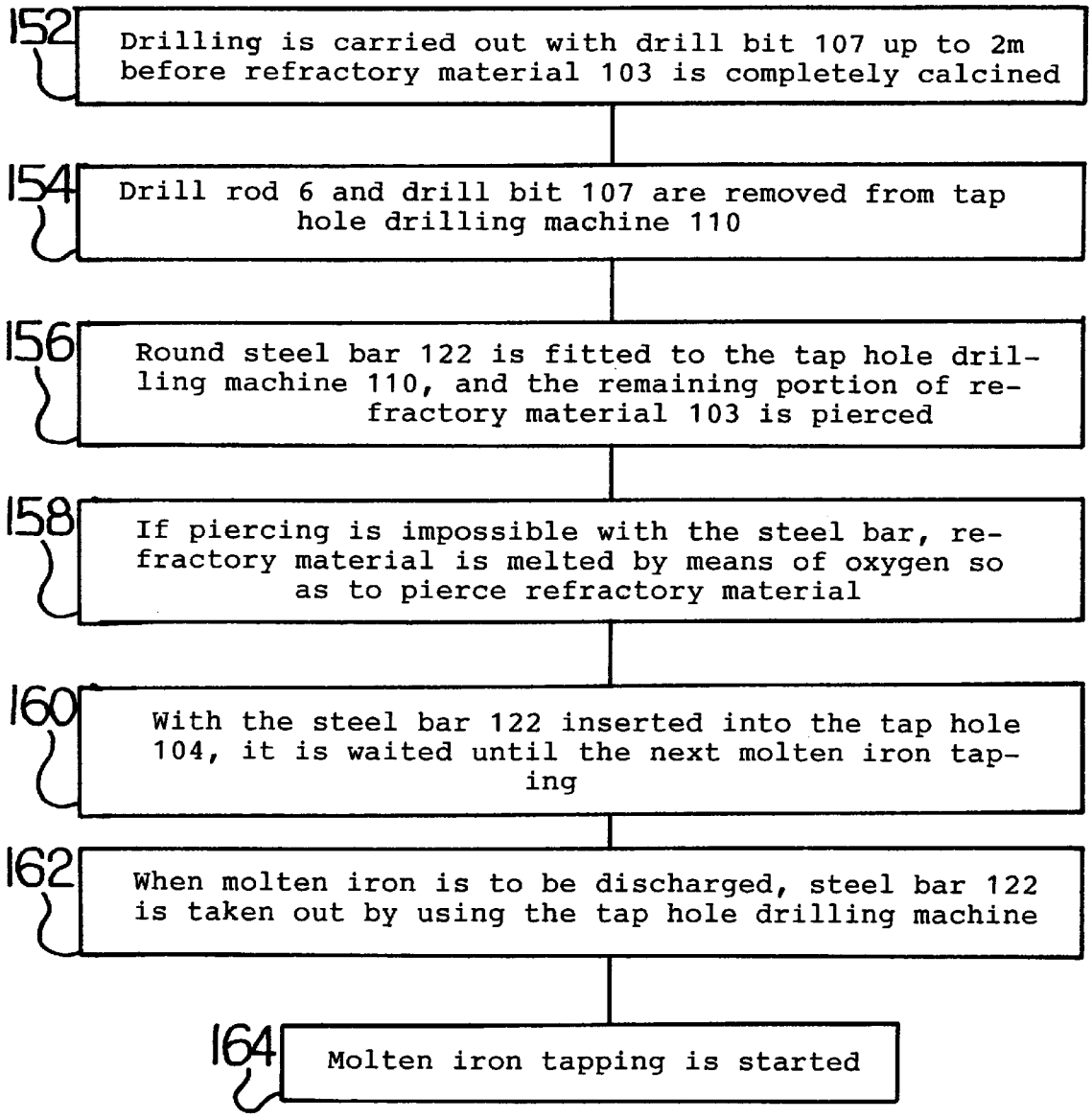
FIG. 2 is a flow chart showing the conventional method of drilling tap holes.
Figure 3:
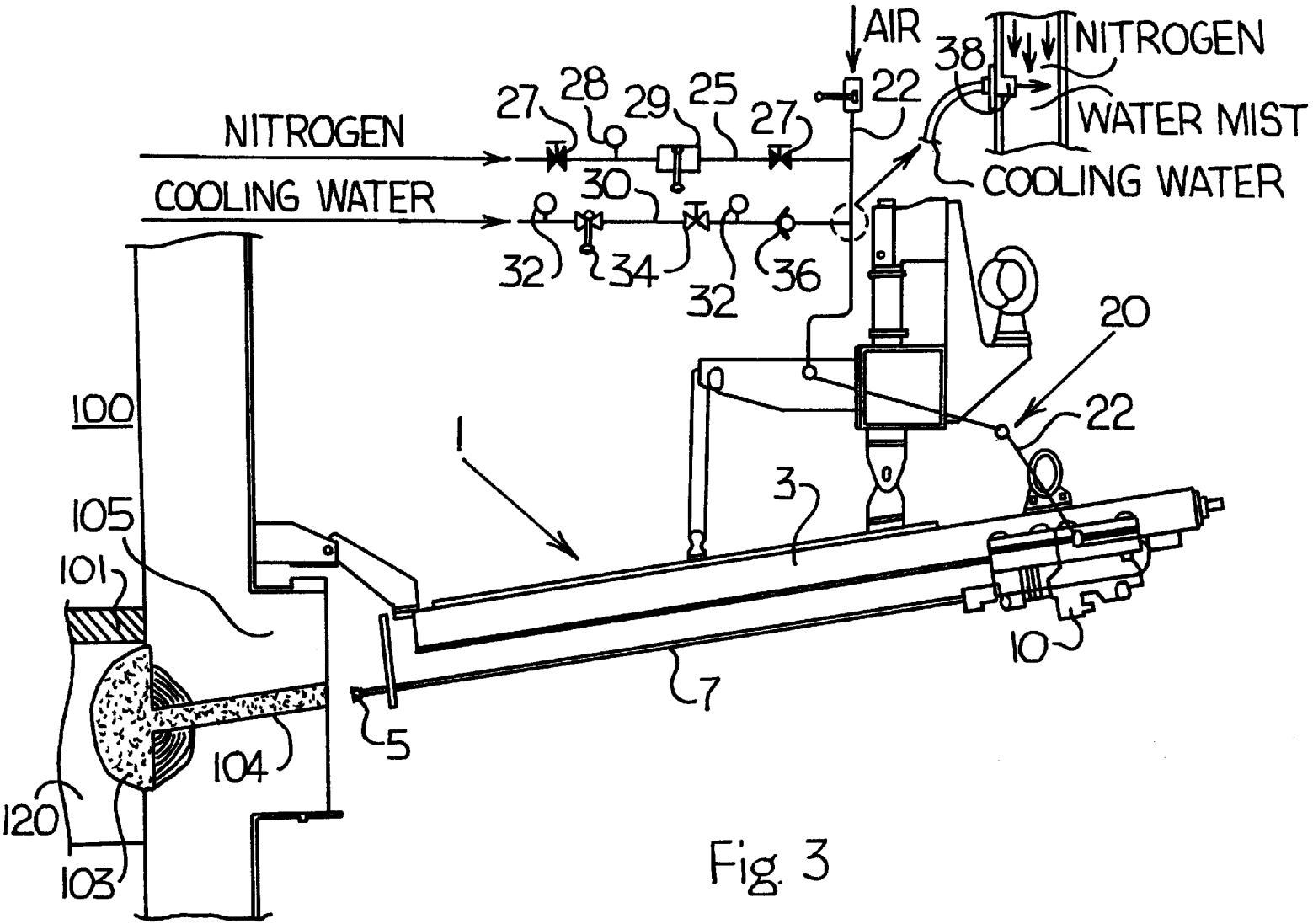
FIG. 3 illustrates the constitution of the tap hole drilling machine for drilling tap holes in a blast furnace according to the present invention.

FIG. 3 illustrates the overall constitution of a tap hole drilling machine 1 according to the present invention.

The tap hole drilling machine 1 includes a frame 3, and beneath the Frame 3, there is installed a drill bit 5 for drilling a tap hole 104 of a blast furnace 100. There is also installed a drill rod 7 with its leading end connected to the drill bit 5. The rear end of the drill rod 7 is detachably attached to a main body 10 of the tap hole drilling machine, and the main body 10 is movable back and forth along the frame 3. Further, the main body 10 rotates the drill rod 7 and the drill bit 5.

A cooling fluid supply means 20 has an air supply line 22, and supplies a cooling fluid through a central flow path of the main body 10 and the drill rod 7. The air supply line 22 is connected through the main body 10 to the drill rod 7 so as to spout air through the leading end of the drill bit 5.

The cooling fluid supply means 20, the main body 10 and the drill rod 7 of the tap hole drilling machine 1 are known components.

An example is the column mounted type tap hole drill of Mazda Motor Corporation of Japan. This tap hole drill has the following specifications. That is, the drill stroke is 5,530 mm, the feed speed is 30 m/min, and it is an air cooling type. The machine includes a drill rod 7 and a drill bit 5 so as to open the tap hole 104. Further, it can install a round steel bar to carry out a hammering operation.

Another example is the tap hole openers of Dango & Dienenthal Siegen of Germany. This machine has the following specifications. That is, the tap hole length is 2.5–3.0 m, the maximum feed length is 5,500 mm, the drilling speed is 1.2 m/min, the retraction speed is 1 nm/sec, and the machine is an air cooling type. The machine supplies air through the drill bit during the drilling operation.

Meanwhile, the tap hole drilling machine according to the present invention includes a cooling fluid supply means 20 consisting of a nitrogen supply line 25 and a cooling water supply line 30, which are not found in the conventional tap hole opening machines. The nitrogen supply line 25 and the cooling water supply line 30 are connected to an air supply line 22 of the cooling fluid supply line 20. Thus either nitrogen and a cooling water are supplied to the air supply line 22, or a water mist consisting of nitrogen and a cooling water is supplied. Therefore, instead of air, the cooling water or nitrogen or the water mist in which the cooling water is mixed with a high pressure nitrogen can be selectively supplied toward the central flow path of the drill rod 7 which is connected to the air supply line 22.

The nitrogen supply line 25 includes a plurality of pressure reduction valves 27, a pressure gage 28 and a manipulation valve 29. Thus the supplied nitrogen can be adjusted to the optimum flow rate and to the optimum pressure.

Meanwhile, the cooling water supply line 30 includes a plurality of pressure gages 32, a flow rate adjusting valve 34 and a check valve 36. Further, at the point where the cooling water supply line 30 is connected to the air supply line 22, there is installed a nozzle 38 within the air supply line 22, so that the high velocity nitrogen passing through the nozzle 38 can form a water mist together with the cooling water.

That is, through an internal air flow path of the air supply line 22, a high pressure nitrogen gas is made to flow. Then the cooling water is made to be introduced into the stream of the carrying nitrogen gas. Thus, owing to the collision pressure between the nitrogen gas and the cooling water, the cooling water is transformed into a water mist so as to be supplied through the drill rod 7 to the drill bit 5.

Accordingly, when a tap hole 104 is subjected to an opening operation, a manipulation valve 22*a* of the air supply line 22 is closed, while the nitrogen supply line 25 and the cooling water supply line 30 are opened. Then the water mist is supplied, and the heat which is generated in the main body 10, the drill rod 7 and the drill bit 5 is cooled, while a lubrication is provided to the revolving drill bit 5. Further, the refractory material chips and other debris which are produced during the tan hole opening operation can be easily discharged. Thus the opening operation for the tap hole 104 can be efficiently carried out.

Instead of the nitrogen gas, air can be made to serve as the carrying gas, and this can be achieved simply by switching by means of a valve. In this case, the water mist consists of air and the cooling water.

Figure 4:
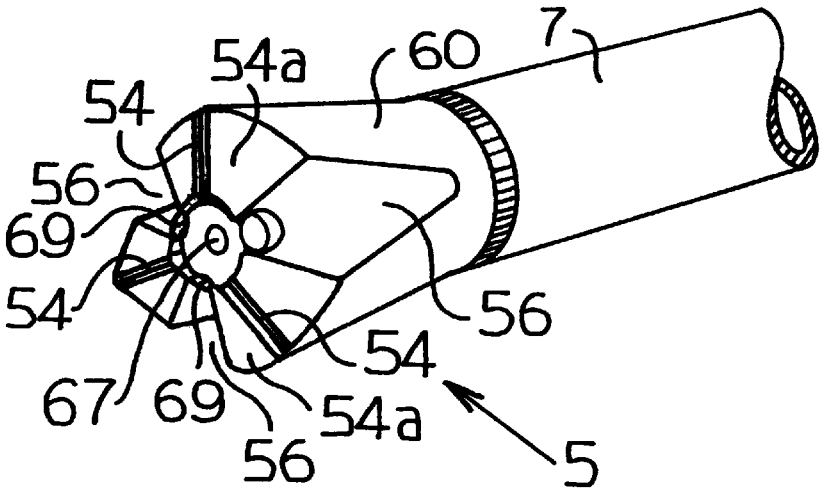
FIG. 4 is a perspective view of the drill bit according to the present invention.
Figure 5:
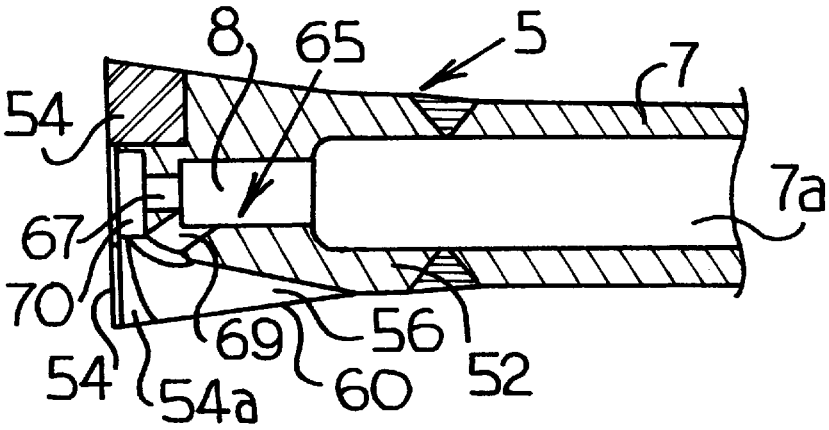
FIG. 5 is a sectional view showing the drill bit attached to the drill rod according to the present invention.
Figure 6:
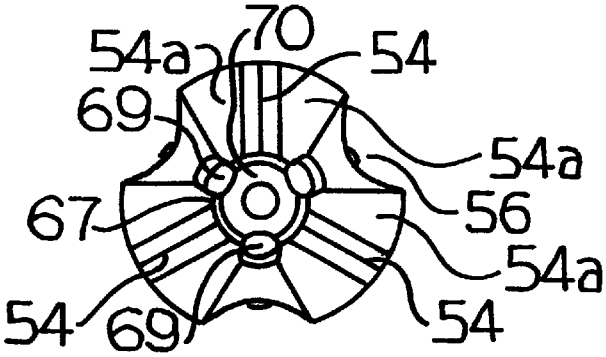
FIG. 6 is a frontal view of the drill bit of FIG. 5.

Meanwhile, in the tap hole drilling machine 1 according to the present invention, the drill bit 5 has a novel structure as illustrated in FIGS. 4 to 6. That is, during the opening operation for the tap hole 104, frictions with the refractory material 103 within the tap hole 104 are minimized, and the distortion of the drill bit 5 is inhibited.

The drill bit 5 according to the present invention includes a drill body 52 with its rear end attached to the leading end off the drill rod 7. The drill bit 5 further includes a Plurality of bit blades 54 which are installed on the leading end of the drill body 52 angularly parted. Between the bit blades 54, there are formed triangular recesses 56. In the drawings, three bit blades 54 are provided, and on the both sides of each of the bit blades 54, there are formed inclined faces 54*a*. Between the inclined Faces 54*a*, there are formed the triangular recesses 56.

The circumferential surface of the drill body 52 forms a tapered portion 60. That is, the outside diameter of the drill body 52 is decreased from the leading end of the drill body toward the rear end of it. Thus the drill bit 5 has the largest outside diameter at the leading end where the bit blades 54 are attached.

Within the drill body 52, there is formed a cooling fluid flow path 65. The cooling fluid flow path 65 includes: a straight passage 67 formed along the central axis of the drill rod; three inclined passages 69 having a certain angle $\phi$ (15–23°) relative to the straight passage 67; and a spouting mouth 70 having an inside diameter twice the inside diameter of the straight passage 67.

The passages 67 and 69 communicate to a central flow path 7*a* of the drill rod 7, so that the water mist consisting of the cooling water and the nitrogen gas can be supplied from the nitrogen supply line 25 and the cooling water supply line 30 to the passages 67 and 69.

The bit blades 54 are made of a super alloyed metal 11, and the drill body 52 is made of the general steel. Thus the rear end of the drill body 52 is welded to the leading end of the drill rod 7.

As described above, the drill bit 5 of the present invention has a tapered portion, and thus, the outside diameter of the drill body 52 is decreased from its leading end toward the rear end. Therefore, when drilling the tap hole 104, if the drill bit 5 is inserted into the tap hole 104, there is formed a cylindrical gap between the inner circumference of the tap hole 104 and the outer circumference of the drill bit 5.

Consequently, the frictions between the refractory material 103 and the drill bit 5 is minimized, and the revolution resistance is also minimized, with the result that the distortion of the drill bit 5 within the tap hole 104 is inhibited.

Further, the opening debris such as the refractory chips and the water mist consisting of the nitrogen gas and the cooling water can be easily discharged through the cylindrical gap which is formed between the outer circumference of the drill bit 5 and the inner circumference of the tap hole 104. Therefore, the opening debris will not impede the revolutions of the drill bit 5.

When the water mist consisting of the nitrogen gas and the cooling water is supplied, the spouting mouth 70 which has an expanded diameter relative to the inside diameter of straight passage 67 forms air pockets within the tap hole 104 so as to provide a lubrication. Consequently, the drill bit 5 is efficiently cooled, and the revolutions are not impeded.

Therefore, even under the hot environment within the tap hole 104, the tap hole opening operation is improved, the cooling efficiency is reinforced, and the life expectancy of the drill bit 5 is extended.

Figure 7A:
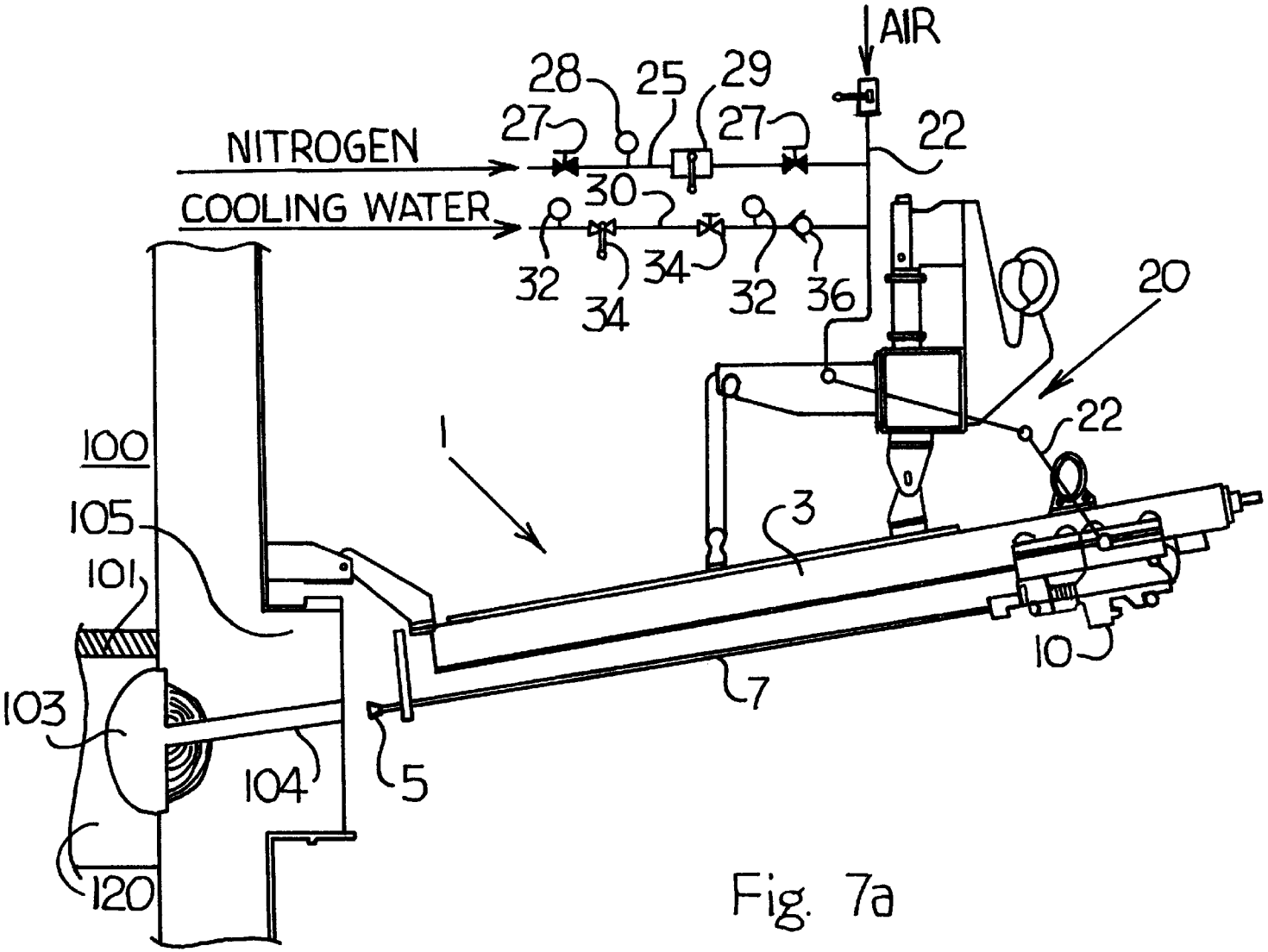
FIG. 7A illustrates a state in which the tap hole opening operation is made ready.
Figure 7B:
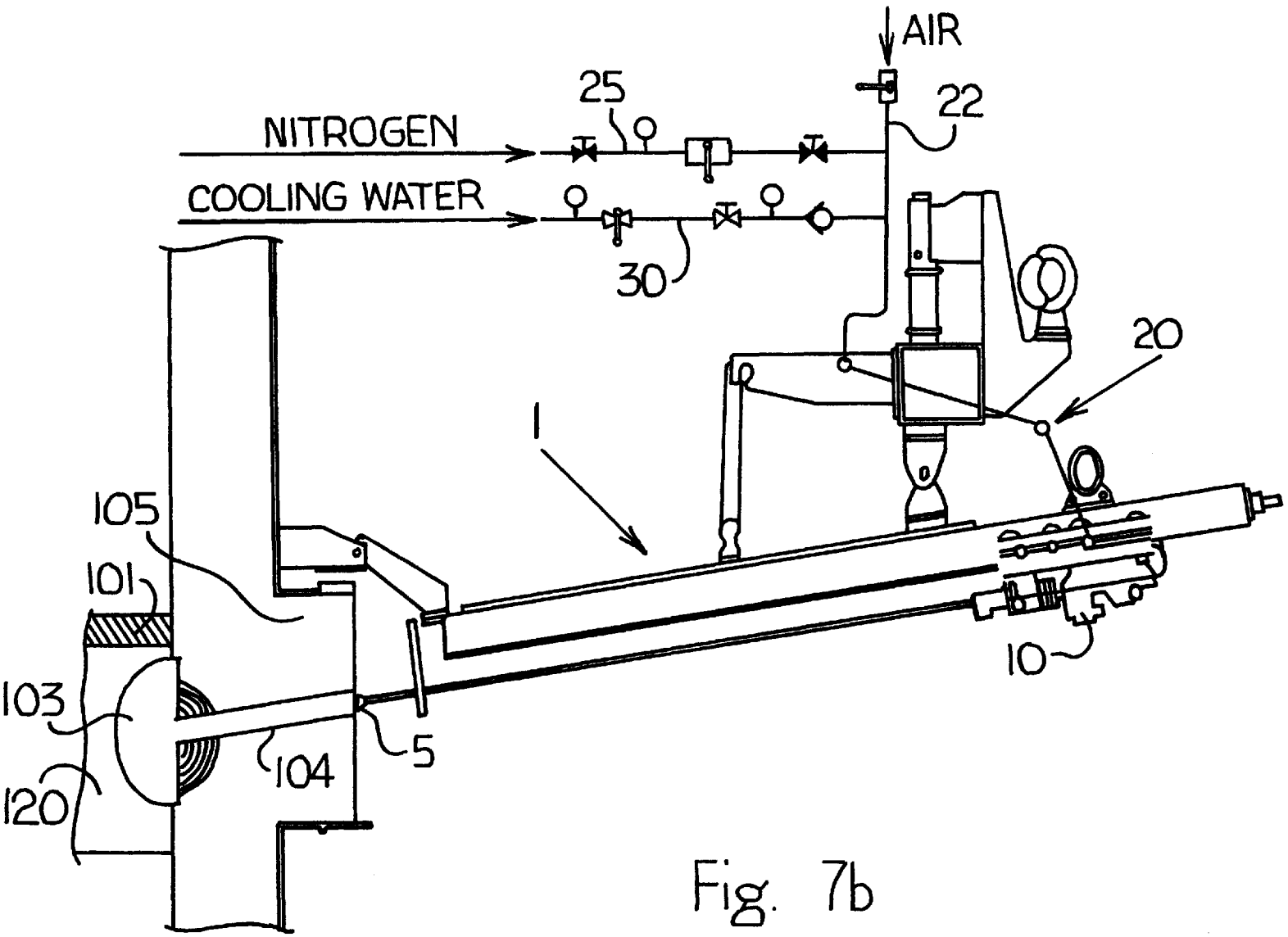
FIG. 7B illustrates a state in which the drill bit drills the tap hole.
Figure 7C:
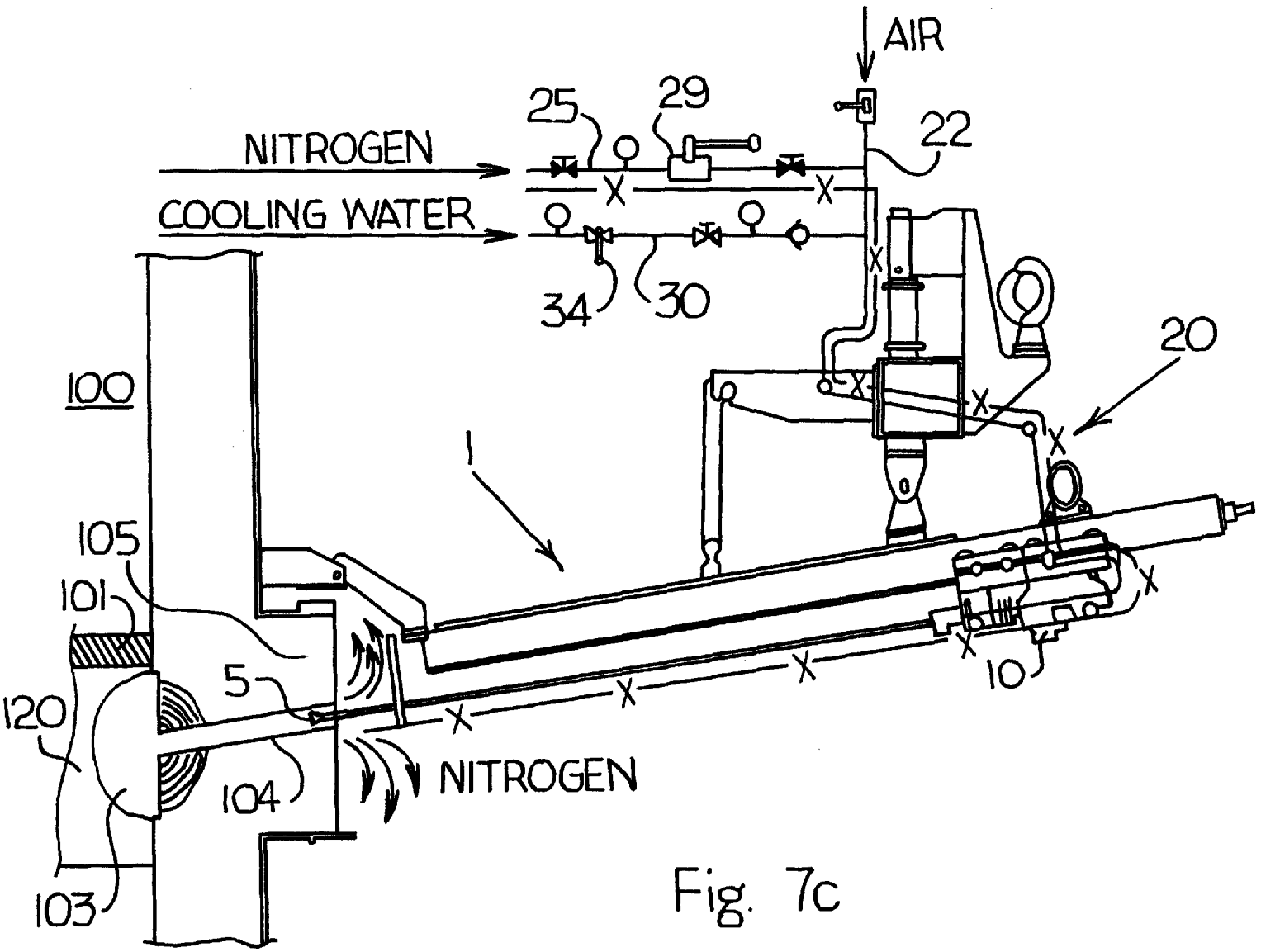
FIG. 7C illustrates a state in which the nitrogen gas is being injected upon completion of the position adjustment of the drill bit.
Figure 7D:
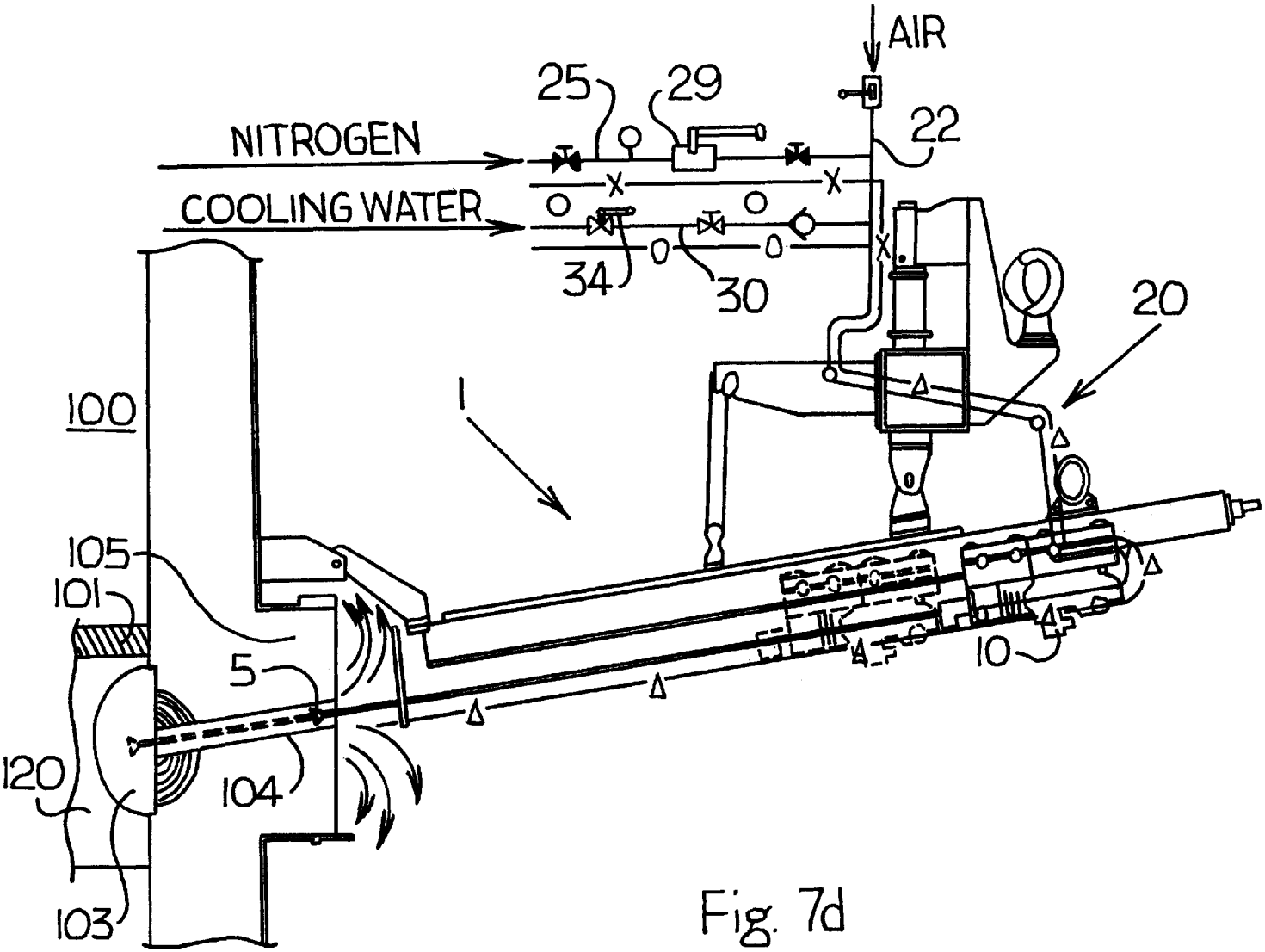
FIG. 7D illustrates a state in which the nitrogen gas and cooling water are supplied to form a water mist, and then the drilling operation is being carried out.
Figure 7E:
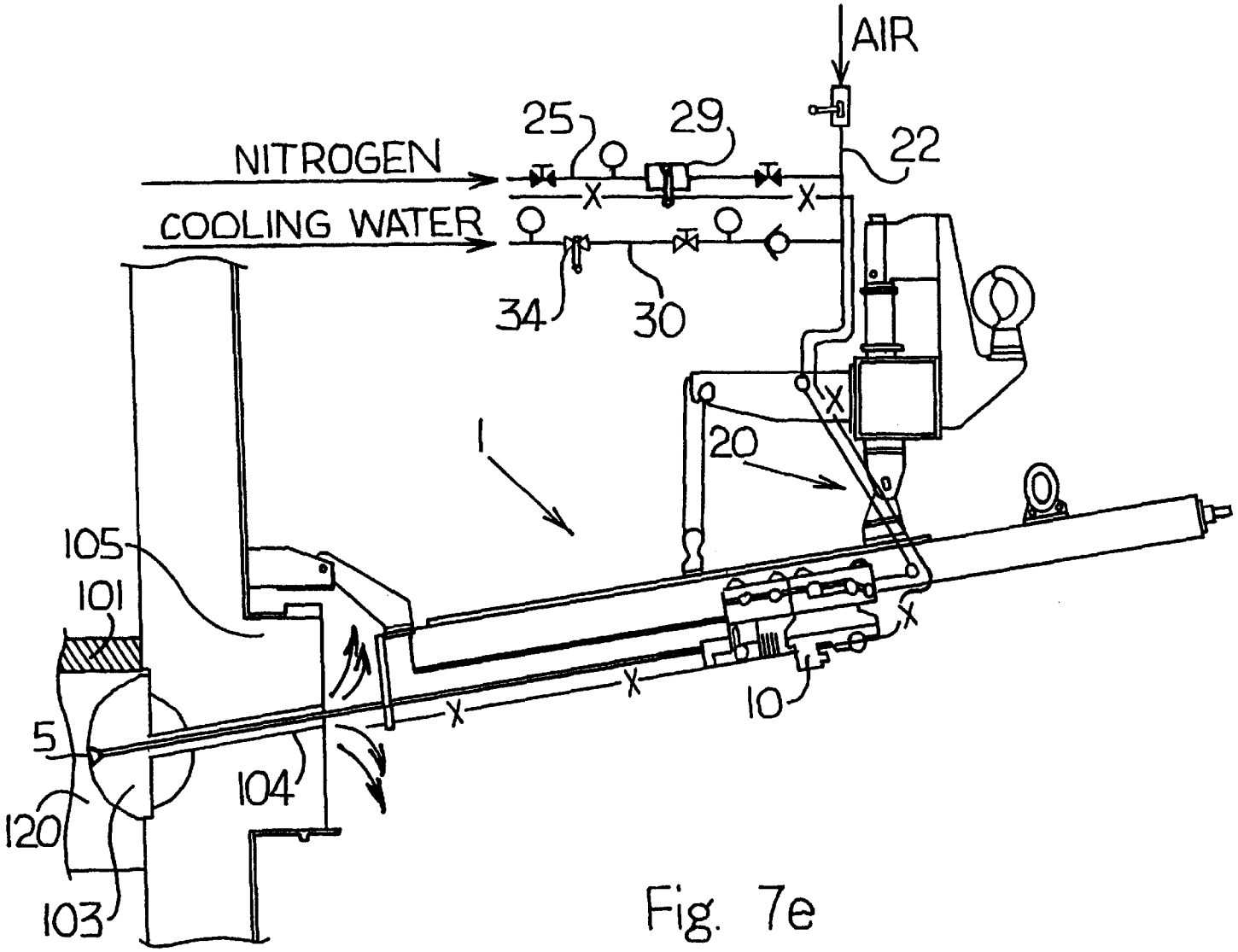
FIG. 7E illustrates a state in which the supply of the cooling water is stopped, but the nitrogen gas is being continuously supplied, upon confirmation of the piercing of the tan hole.
Figure 7F:
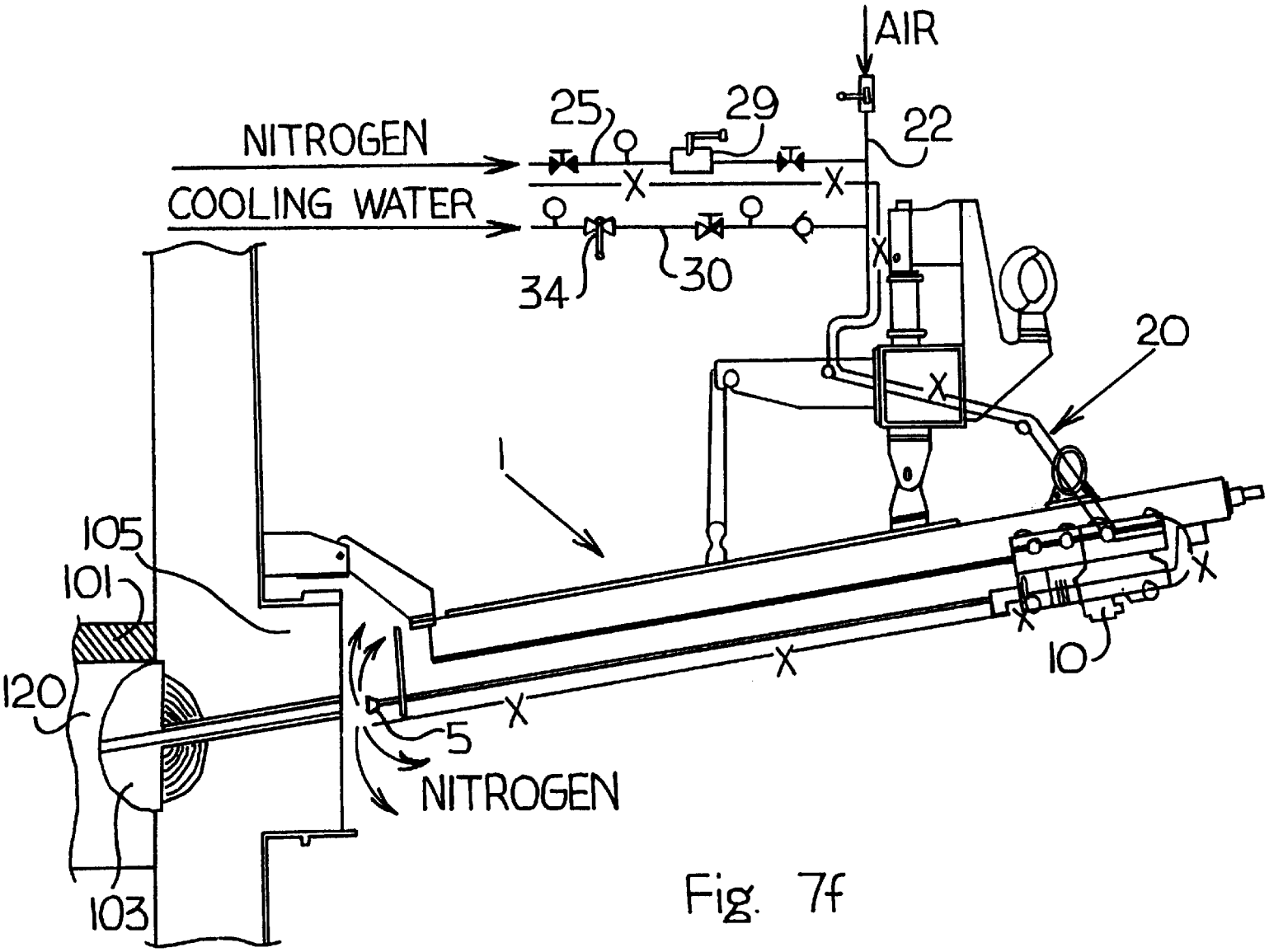
FIG. 7F illustrates a state in which the drill bit is restored to the initial position.
Figure 8:
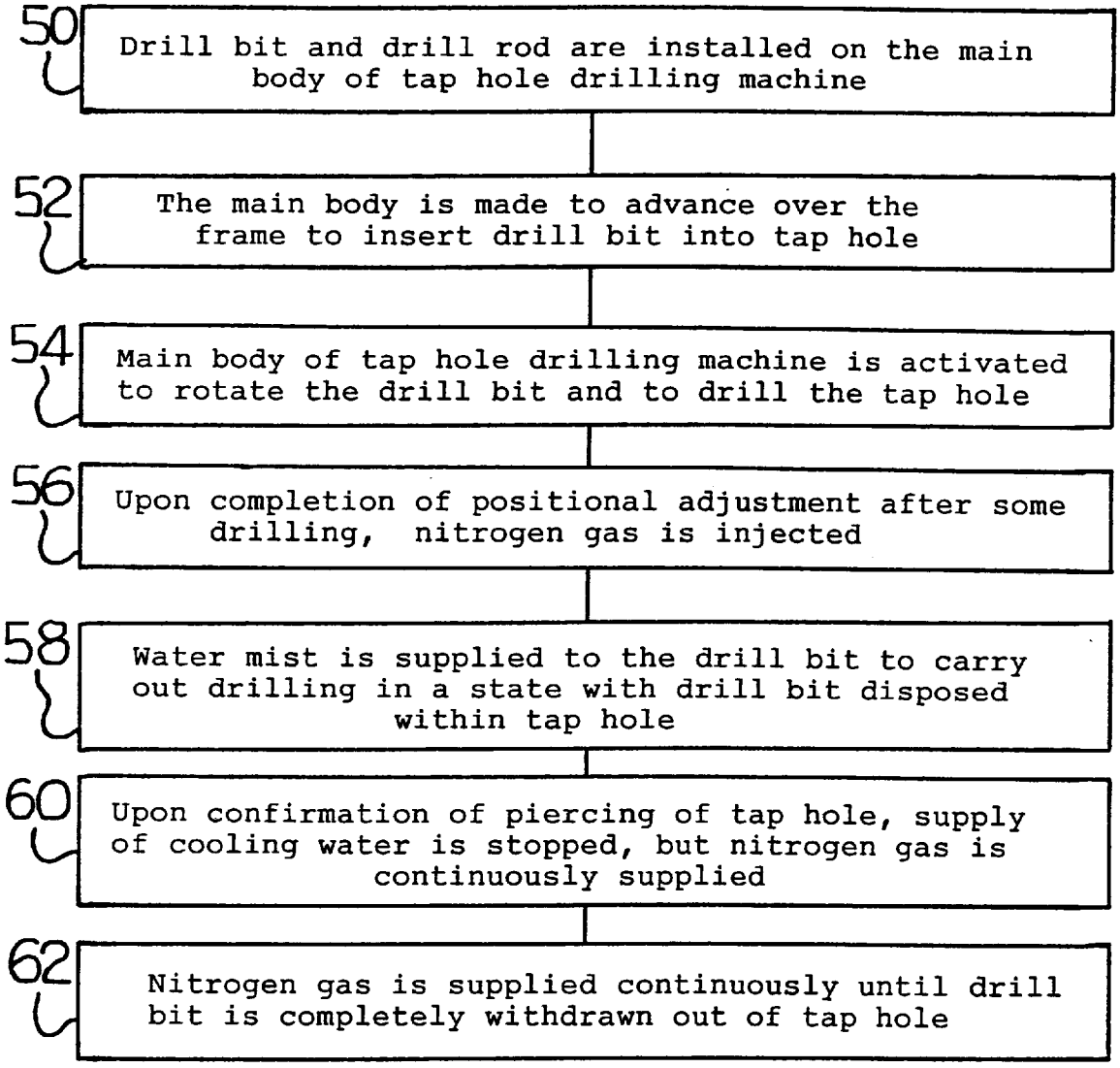
FIG. 8 is a flow chart showing the process steps of the tap hole drilling method according to the present invention.

FIGS. 7 and 8 illustrate the tap hole drilling method according to the present invention.

In this method, the explosion of the water mist upon being contacted with the hot molten iron within the tar hole 104 is prevented, while a reverse flow of the molten iron from the blast furnace 100 into the cooling fluid flow path is inhibited.

The tap hole drilling method according to the present invention proceeds in the following manner.

As a first step, checks are made on the status of the tap hole drilling machine 1, and the pressures of the cooling water supply line 25 and the nitrogen gas supply line 30. Then the drill bit 5 and the drill rod 7 are installed on the main body 10 of the tap hole drilling machine 1 (step 50) (refer to FIG. 7A).

Then a checks is made on the cooling water spouting state. Specifically, the nitrogen gas supply line 25 is opened to inject the nitrogen gas into the air supply line 22. After elapsing of 5–10 seconds, the cooling water supply line 30 is opened to supply the cooling water into the stream of the nitrogen gas. Thus it is confirmed as to whether the water mist is being spouted from the leading end of the drill bit 5. After the confirmation of the spouting of the water mist, the valve 34 of the cooling water supply line 30 is closed, and after elapsing of 5–10 seconds, the valve 29 of the nitrogen gas supply line 25 is closed.

In accordance with the operation procedure of the tap hole drilling machine 1, the main body 10 of the tap hole drilling machine 1 is made to advance, and the drill bit 5 is fitted to the tap hole 104. Then an advancing lever (not shown in the drawings) is manipulated in such a manner that the drill bit 5 is aligned with and fitted into the tap hole 104 (step 52)(refer to FIG. 7B).

Then the main body 10 is activated to rotate the drill bit 5, and the drill bit 5 is made to drill into the tap hole 104 by about 50 mm. (step 54).

Then an adjustment is made to coaxially align the drill bit 5 with the tap hole 104. Then a drilling is made into the tap hole 104 by about 50–100 mm. Then the nitrogen gas supply line 25 is opened to inject the nitrogen gas (step 56).

When the drill bit 5 advances into the tap hole 104 up to a point of 200–300 mm, the cooling water supply line 30 is opened to produce the water mist so as to supply it to the drill bit 5. In this way, the drilling operation is continued (step 58) (refer to FIG. 7D).

At step 58, the pressure of the cooling water is maintained at 11–13 $Kg/cm^2$, the flow rate of the cooling water at 10–12 liter/min, and the pressure of the nitrogen gas at 10–12 $Kg/cm^2$.

Under this condition, if the drill bit 5 is made to advance too fast, the drill bit 5 may be damaged or the drill bit may fixedly adhere within the tap hole 104, with the result that the revolutions of the drill bit 5 are stopped. Therefore, care should be exercised in making the drill bit 5 advance. Then upon encountering the piercing of the tap hole 104, immediately the valve 34 of the cooling water supply line is locked to stop the supply of the water mist, but only the nitrogen gas is continuously injected (step 60) (refer to FIG. 7E).

The nitrogen gas is continuously supplied until the drill bit 5 is completely withdrawn to the outside of the tap hole 104 (step 62) (refer to FIG. 7F).

At the steps 60 and 62, the supply of the nitrogen gas makes it possible to carry out a stable molten iron discharge operation, because the tap hole 104 is filled with the nitrogen gas during the discharge of the molten iron 120 and the slag 101. Further, the clogging of the cooling fluid path of the drill bit 5 by the molten iron 120 and the slag 101 is prevented.

In the present invention as described above, the step of replacing the drill bit 5 and the drill rod 7 with a round steel bar and making the round steel bar ready to go into the tap hole 104 is omitted, thereby simplifying the tap hole opening procedure. Rather, the tap hole drilling is completed in a short period of time so as to improve the efficiency of the tap hole opening operation. Further, the water mist consisting of the nitrogen gas and the cooling water is used, with the result that the cooling efficiency is improved.

Now the present invention will be described based on an actual example.

<Example>

In order to prove the effects of the present invention, a water mist was formed by mixing a cooling water into a high pressure nitrogen carrying gas. This water mist was spouted into the tap hole, while the method of drilling the tap hole according to the present invention was carried out using the drill bit and the tap hole drilling machine of the present invention First, in order to form the water mist, the pressure and the flow rate of the cooling water were made to be varied within ranges of 5–15 Kg/cm$^2$ and 6–15 liter/min, while the pressure of the nitrogen gas was made to be varied within a range of 6–13 Kg/cm$^2$. The results are shown in Table 1 below.

Meanwhile, in order to adjust the spouting angle of the water mist, the drill bit 5 was provided with one straight spouting passage 67 and three inclined spouting passages. In order to make the discharge of the opening debris efficient, the inclined passages 69 were made to have an angle ∠ of 15–23° relative to the straight spouting passage 67. These can be summarized as shown in Table 1 below.

TABLE 1

| | Variation | Results |
|---|---|---|
| Flow rate of cooling water (l/min) | Less than 10 | Opening speed was low due to the low cooling capability, and so, drilling failed. |
| | 10–12 | Excellent |
| | More than 12 | Residual water existed within the tap hole due to too much supply of water, and so an explosion was possible. |
| Pressure of cooling water (Kg/cm$^2$) | Less than 11 | Opening speed was low due to the low cooling capability, and so, drilling failed. |
| | 11–13 | Excellent |
| | More than 13 | Problems occurred in the mechanical actuation. |
| Nitrogen pressure (Kg/cm$^2$) | Less than 10 | Drilling failed due to an inefficient discharge of the opening debris. |
| | 10–12 | Excellent |
| | More than 12 | When nitrogen pressure was higher than the water pressure, the cooling capability was lowered due to the lowering of the spouting capability of the water mist, and so the drilling speed was slow. |

As can be seen in Table 1 above, during the drilling of the hot tap hole 104, the drill bit 5 showed an excellent cooling capability when the pressure of the cooling water was 11–13 Kg/cm$^2$, and when the flow rate of the cooling water was 10–12 liter/min. At a nitrogen gas pressure of 10–12 Kg/cm$^2$, the cooling water spouting was excellent, and the discharge of the opening debris was efficient.

The drilling showed further results as follows. That is, the tap hole drilling time period was shortened from the conventional 20 minutes to 5 minutes. Further, the round steel bar as well as the hammering was not used, and therefore, the cracks formed in the refractory material in the conventional technique were completely eliminated. Further, the conventional oxygen pipe was not used, and therefore, the expansion of the interior of the tap hole and the shortening of the tap hole depth were avoided. Consequently, the drilling time could be shortened, and therefore, the molten iron discharge time period was extended, with the result that the productivity was improved.

Further, the tap hole had a uniform cylindrical interior contour, and therefore, the amount of the refractory material required for closing the tap hole was significantly decreased.

These can be summarized as shown in Table 2 below.

TABLE 2

| | Conventional | Present invention |
|---|---|---|
| Drilling time (min) | 20 | 5 |
| Oxygen use times ratio (%) | 30 | 0 |
| Amount of refractory (Kg/ton of molten iron) | 450 | 250 |
| Refractory consumption (Kg/ton of molten iron) | 0.45 | 0.30 |
| Inside crack (%) | 10 | 0 |
| Molten iron discharge (times/day) | 10.5 | 9 |
| Molten iron discharge period (min) | 120 | 150 |

According to the present invention as described above, the water mist cooling method and an efficient drilling method are adopted. Consequently, the tap hole is speedily drilled, the drilling time period is markedly shortened, the molten iron discharge time period is significantly increased, and the net consumption rate of the refractory material is considerably decreased. Further, the molten iron discharge time period is extended, and the molten iron discharge operation is rendered easier. Therefore, by properly adjusting the amount of the molten iron existing within the lower portion of the blast furnace, the condition of the blast furnace can be stabilized, and the productivity can be improved. Further, the disadvantageous conditions for the drilling operation can be improved to advantageous conditions even under a high pressure and a high temperature environment.

What is claimed is:

1. A drill bit for use in a tap hole drilling machine, said drill bit comprising:

a drill body with its rear end connected to a leading end of a drill rod of the tap hole drilling machine;

a plurality of bit blades attached to the leading end of said drill body;

triangular recesses formed between said bit blades;

a tapered portion with diameters of said drill body decreasing from its leading end to its rear end; and a cooling fluid flow path consisting of a straight passage formed along a center line of said drill body, and a plurality of inclined passages with a certain angle relative to an axis of said straight passage, wherein the drill bit further includes a spouting mouth having a larger diameter than that of said straight passage and is formed on a tip of said straight passage so as to form air pockets within said tap hole, whereby said drill bit is efficiently cooled, and revolution resistances are minimized.

2. The drill bit as claimed in claim 1, wherein said inclined passages have an angle $\phi$ of 15–23° relative to said straight passage.

3. A method for drilling a tap hole while spouting a cooling fluid into a tap hole of a blast furnace, comprising the steps of:

installing a drill bit and a drill rod to a main body of a tap hole drilling machine;

making said main body of said tap hole drilling machine advance to admit said drill bit into said tap hole;

activating said main body of said tap hole drilling machine to rotate said drill rod and said drill bit so as to drill said tap hole with said drill bit;

making said drill rod fixedly oriented in a lengthwise direction within said tap hole after some drilling, and supplying a nitrogen gas through said main body of said tap hole drilling machine, through said drill rod and through said drill bit into said tap hole;

supplying a cooling water to be mixed with the nitrogen gas so as to form a water mist, with said drill bit lying within said tap hole, and proceeding with the drilling operation while supplying the water mist;

stopping the supply of the cooling water but continuously supplying the nitrogen gas after confirming a piercing of said tap hole; and injecting the nitrogen gas continuously until said drill bit is completely withdrawn out of said tap hole.

4. The method as claimed in claim 3, wherein, at the fifth step, the cooling water is maintained at a pressure of 11–13 $Kg/cm^2$, and at a flow rate of 10–12 liter/min, and the nitrogen gas is maintained at a pressure of 10–12 $Kg/cm^2$.

* * * * *

UNITED STATES PATENT AND TRADEMARK OFFICE

CERTIFICATE OF CORRECTION

PATENT NO. : 6,086,816
DATED : July 11, 2000
INVENTOR(S) : Joung Yul LEE et al.

It is certified that error appears in the above-identified patent and that said Letters Patent is hereby corrected as shown below:

Column 2 Line 13 "tan hole" should read --tap hole--.

Column 2 Line 54 "material chins" should read --material chips--.

Column 3 Line 31 between "round" and "bar" delete hyphen (-).

Column 4 Line 20 after "frame" insert --;--.

Column 5 Line 33 "tan hole" should read --tap hole--.

Column 5 Line 44 "the Frame" should read --the frame--.

Column 6 Line 5 "nm/sec" should read --m/sec--.

Column 6 Line 48 "tan hole" should read --tap hole--.

Column 6 Line 64 "off" should read --of--.

Column 6 Line 64 "a Plurality" should read --a plurality--.

Column 7 Line 3 "inclined Faces" should read --inclined faces--.

UNITED STATES PATENT AND TRADEMARK OFFICE

CERTIFICATE OF CORRECTION

PATENT NO. : 6,086,816

DATED : July 11, 2000

INVENTOR(S) : Joung Yul Lee et al.

It is certified that error appears in the above-identified patent and that said Letters Patent is hereby corrected as shown below:

Column 7 Line 59 "tar hole 104" should read --tap hole 104--.

Column 8 Line 4 "a checks" should read --a check--.

Column 9 Line 10 after "invention" insert period (.).

Column 9 Line 61 after "hammering" insert --operation--.

Signed and Sealed this

Tenth Day of April, 2001

Nicholas P. Godici

*Attest:*

NICHOLAS P. GODICI

*Attesting Officer*

*Acting Director of the United States Patent and Trademark Office*